United States Patent [19]

Ulrich

[11] 4,373,764

[45] Feb. 15, 1983

[54] ELECTRICAL CONNECTOR

[75] Inventor: Bohdan Ulrich, Kehrsatz, Switzerland

[73] Assignee: Hasler AG Bern, Bern, Switzerland

[21] Appl. No.: 239,892

[22] Filed: Mar. 3, 1981

[30] Foreign Application Priority Data

Mar. 28, 1980 [CH] Switzerland ..... 2461/80

[51] Int. Cl.[3] ..... H01R 13/629

[52] U.S. Cl. ..... 339/75 MP; 339/47 R; 29/854

[58] Field of Search ..... 339/74 R, 74 N, 75 M, 339/75 MP, 176 M, 47 R, 91 R, 64 R, 64 M; 29/854

[56] References Cited

U.S. PATENT DOCUMENTS

| | | | |
|---|---|---|---|
| 3,218,599 | 11/1965 | Winkler | 339/47 R |
| 3,389,370 | 6/1968 | Davis | 339/176 M X |
| 3,731,252 | 5/1973 | McKeown et al. | 339/75 MP X |
| 3,831,133 | 8/1974 | Grundfest | 339/47 R X |
| 3,858,957 | 1/1975 | Harwood et al. | 339/74 R X |
| 4,200,349 | 4/1980 | Holland | 339/75 MP |

*Primary Examiner*—Eugene F. Desmond
*Attorney, Agent, or Firm*—Horst M. Kasper

[57] ABSTRACT

A class of electrical connectors is provided wherein the socket employs an elastic element actuated by the insertion process of the plug into the connector and which elastic element assures a pressure contact between two contact elements. A female multipoint connector can provide a socket for a printed circuit board. The female multipoint connector supports two rows of weakly elastic conducting electrical contact elements. The contact elements are touched on their outside by strand-shaped elastic elements. The strand-shaped elements are captive disposed in slot openings in the longitudinal walls of the multipoint connector and protrude on the side beyond the longitudinal wall. The printed circuit board can be inserted into the opening of the female multipoint connector with its contact strip ending on a protrusion. The printed circuit board supports on both sides rigidly attached clamping elements. The clamping elements have an L-shaped cross-section and their inner sides are bevelled.

28 Claims, 11 Drawing Figures

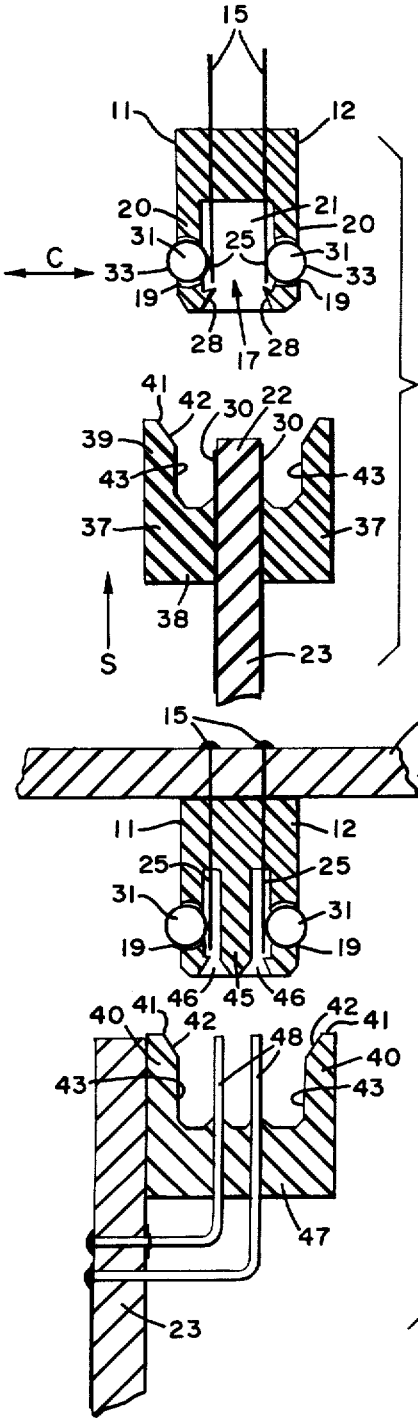
FIG. 2
FIG. 5
FIG. 6a
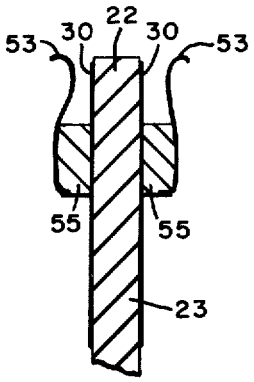
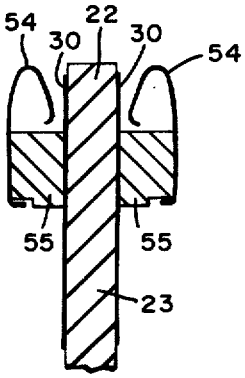
FIG. 6b

ELECTRICAL CONNECTOR

DESCRIPTION

BACKGROUND OF THE INVENTION

1. Field of the Invention

The present invention relates to a plug connector for providing a disconnectable rapid electrical coupling between preferably a plurality of conducting electrical contact elements insulated with respect to each other and an equal number of conductors disposed in a plug and to a method for making electrical connections.

2. Brief Description of the Background of the Invention Including Prior Art

Plug connectors for receiving and contacting of printed circuit boards are known in the art as female multipoint connectors. Metal springs serve as contact elements for the female multipoint connectors and such springs can be made for example from spring bronze. They provide the three functions of conducting the current, providing a contact and generating the contact pressure required for obtaining a suitable contact.

The contact pressure required for providing a problem-free contact is relatively large. With longer multiple contact strips there is therefore required a considerable total force for the inserting of the conductor plate. This force has to be overcome upon insertion of the printed circuit board by pressing apart the springs with the circuit board edges, which are bevelled for this purpose. The contact surfaces of the springs become considerably worn from the material of the printed circuit boards such as for example fiber-glass reinforced epoxyresin as well as from the sharp edges of the pulled conductors. Furthermore, the dimensions of the springs have to be kept relatively large to assure permanently sufficient spring forces. This in turn prevents a reduction in size of the multiple contact strips or respectively prevents an increase in the number of contacts with the same size of strip.

It is known that in zero insertion force connectors (sold for example by Cannon, DL-series) the spring properties of the springs are separated from the contacting properties. The contact pressure required for providing adequate contact between the contact elements of the one and the other plug element is provided after the force free insertion by a force provider such as for example a cam. The zero insertion force connectors are subject to only minor wear and assure a uniform contact pressure for all contact elements. In view of the present day construction of electronic instruments it is however a disadvantage, that the zero insertion force connectors have to be accessible from two sides that is first for the insertion of the board to be inserted and second for operation of the force provider. It is also disadvantageous that during the providing of the contact there is little rubbing between the contact surfaces or none and thus the thereby effected self-purification is small.

An electrical connector is known from European Patent application 0014511 (application number 80 200 104.0) where the contact elements exhibit only the properties of current conduction and contact providing, whereas the contact pressure necessary for providing contacts is generated by a force diverter during the insertion process. This force diverter is a permanent elastic element, which is compressed via profile surfaces upon insertion of the printed circuit board to be contacted. Based on the shape of the profile surface, the force diverter escapes in a cross direction to the plugging and thereby presses the by now next to each other positioned and with each other to be contacted connection elements against each other. A snap-in connection keeps the arrangement in connected position against the restoring force of the permanent elastic element.

In the above cited plug connector the contact pressure for providing of good contacts is generated during the step of insertion as is done in case of conventional multipoint contact strips. This is a considerable advantage as compared with the described zero insertion force connectors. A disadvantage of this arrangement is however that in the insertion state a permanent force is acting trying to press the printed circuit board again out of the connection by acting against the plug-in direction. In fact, this is prevented by the snap-in connection. This snap-in connection however is relatively complicated, since the available space is limited for example for an overlift motion for allowing the intended pulling out.

SUMMARY OF THE INVENTION

Purposes of the Invention

It is an object of the present invention to provide a connector where the circuit board to be contacted can be inserted as into a conventional multiple contact strip via a socket opening, however wherein the contact elements do not exert a direct force against each other.

It is another object of the present invention to provide a connector where the contact forces are provided during the plugging process and where in the inserted state no forces result acting in a direction opposite to the plug-in direction.

It is a further object of the present invention to provide a connector assuring safe support to an inserted printed circuit board.

These and other objects and advantages of the present invention will become evident from the description which follows.

Brief Description of the Invention

The present invention provides mated connectors for providing a disconnectable electrical contact including a socket and a plug. The socket comprises a conducting electrical contact element connected through a support element, a limb attached to the support element running about parallel to the conducting electrical contact element and having a diameter in a direction about vertical to the surface of the conducting electrical contact element and forming together with the conducting electrical contact element a width in a direction about vertical to the surface of the conducting electrical contact element, and an elastic element captively disposed in a hole in the limb and located closely adjacent to the conducting electrical contact element and protruding on the side of the limb opposite to the location of the conducting electrical contact element and being of larger extension in the direction of the diameter of the limb than the diameter of the limb. The plug comprises a conductor disposed on a shell for engaging the conducting electrical contact elements, a clamping arm extending for roughly the same length as the conductor and running about parallel to the conductor at a clearance distance of approximately slightly more than the width of the limb and the conducting contact element and having a bevelled edge near the tip of the arm disposed toward the conductor and providing at the tip of the arm a clearance between conductor and clamping arm of larger than the total width of the elastic element and the conducting electrical contact element.

The socket can comprise a plurality of conducting electrical contact elements insulated with respect to each other and the plug can comprise a plurality of conductors insulated with respect to each other. The socket and plug are preferably mated for forceless insertion into each other with the conducting electrical contact element about parallel to the conductor. The conducting electrical contact element can be flexible and/or can be without substantial spring properties.

Upon insertion the clamping arm can exert a contact pressure via the elastic element pressing the conducting electrical contact element against the conductor. The elastic element can become deformed from the pressure exerted by the clamping arm. The elastic element can be disposed in mechanical contact with the conducting electrical contact element. Preferably, there is a continuous transition from the bevelled edge of the clamping arm to the surface of the clamping arm facing the conductor. The clamping arm can be substantially rigid or can be at least in part spring-elastic. The inside clearance between the conductor and the clamping arm can be lowest in the area where the bevel meets the clamping arm proper.

The socket can be formed as a female multipoint connector with a single plug opening, which comprises at least a row of conducting electrical contact elements disposed next to each other and wherein the female multipoint connector can comprise a slot in a parallel direction to the row, in which slot the elastic element is disposed captively as a strand-like rubber-elastic profile element. The conductors of the plug can be disposed as a printed conductor plate or a printed circuit board having printed conductor strips disposed in parallel on at least one of its two sides and wherein at least one clamp is formed with a U-shaped cross-section by the protrusion of the shell carrying the conductors and by the clamping arm having an L-cross-sectional shape rigidly connected to the conductor plate or printed circuit board supporting the conductors.

The socket can be a female multipoint connector comprising at least one row of next to each other disposed conducting electrical contact elements, wherein to each conducting electrical contact element is coordinated a ridge for securing and supporting in each case an individual second conducting electrical contact element and wherein there is provided a slot opening in the side wall of the female multipoint connector which slot contains captively as an elastic element a strand-shaped rubber-elastic profile element. The plug can form a male multipoint connector comprising at least one row of pins as conductors and wherein the rows of pins are surrounded on both sides by clamping arms which form together with the base of the male multipoint connector the U-shaped clamp.

The socket can have a circular cross-section and the conducting electrical contact elements can have their longitudinal direction in parallel to the circle axis and can be disposed concentrically and the elastic element can be an enlargement of the limb surrounding circularly the conducting electrical contact elements. The plug can be a circular plug comprising a cylindrical center part surrounded by the conductors. The clamping arm can be in part rigidly connected to and surrounding the cylindrical middle part and the conductors and the clamping arm part together with the cylindrical center part can form a circular clamp with U-shaped profile.

The socket and the plug can be identically shaped female multipoint connectors having a U-shaped cross-section and supporting a row of contact elements. The row of conducting electrical contact elements can be disposed next to a limb and the limb can be provided with a slot opening running in parallel to the longitudinal direction of the multipoint connector and a strand-shaped elastic element can be disposed in the slot opening and the clamping arm is bevelled toward the inside like a wedge.

Each conducting electrical contact element can be mechanically connected to a coordinated elastic element or the conducting electrical contact element can be joined with a coordinated elastic element to an inseparable mechanical unit. The elastic element can be a strand-shaped rubber-elastic profile element having a profile comprising an oval part with approximately oval cross-section and a nearly linear part connected thereto and the cross-section of the nearly linear part beginning at the connection point with the oval part can extend toward the outside and an open wedge-shaped slot can be disposed between the oval part and the nearly linear part. The wedge-shaped slot of the profile element can be provided with toothed surfaces such that upon rolling together of oval part and nearly linear part the teeth engage smoothly.

There is also provided a method for making electrical connections which comprise providing a socket having a conducting electrical contact element disposed adjacent to a limb, providing a plug having a conductor and a clamping arm rigidly attached to a shell, plugging the conducting electrical contact element and the limb into the clearance between the conductor and the clamping arm, pressing an elastic element disposed in a slot of the limb with the clamping arm, and pressing the conducting electrical contact element with the elastic element against the conductor.

The socket can comprise a plurality of conducting electrical contact elements each insulated against the others and the plug can comprise a plurality of conductors each insulated against the others. The plugging together of the socket and the plug can be done by a single manipulation of linear plugging together. At the beginning of the plugging together the conducting electrical contact elements and the coordinated conductors can be placed next to each other without the application of force.

Each elastic element can be gripped with a coordinated clamping arm during the plugging-in step, the elastic element can be deformed and the elastic element can be pressed cross to the plugging-in direction against the conducting electrical contact element and thereby the conducting electrical contact element is pressed against the conductor for forming a rigid abutment. At the end of the plugging-in step there is formed a plug connection safe against unwanted opening-up by the clamping of the elastic element with the clamping arm and wherein there is no force exerted opposite to the insertion direction.

The novel features, which are considered as characteristic of the invention are set forth in particular in the appended claims. The invention itself, however, both as to its construction and its method of operation, together with additional objects and advantages thereof, will be understood best from the following description of specific embodiments when read in connection with the accompanying drawing.

BRIEF DESCRIPTION OF THE DRAWINGS

In the accompanying drawings in which are shown several of the various possible embodiments of the invention

FIG. 2 is a sectional view of the female multipoint connector and of the coordinated, directly insertable printed circuit board;

FIG. 5 is a sectional view of a second female multipoint connector and of a coordinated, indirectly insertable printed circuit board;

FIG. 6*a* is a sectional view of a part of a directly insertable printed circuit board with elastic clamping elements;

FIG. 6*b* is a sectional view of a second directly insertable printed circuit board with different elastic clamping elements;

DESCRIPTION OF INVENTION AND PREFERRED EMBODIMENTS

Figure 1:
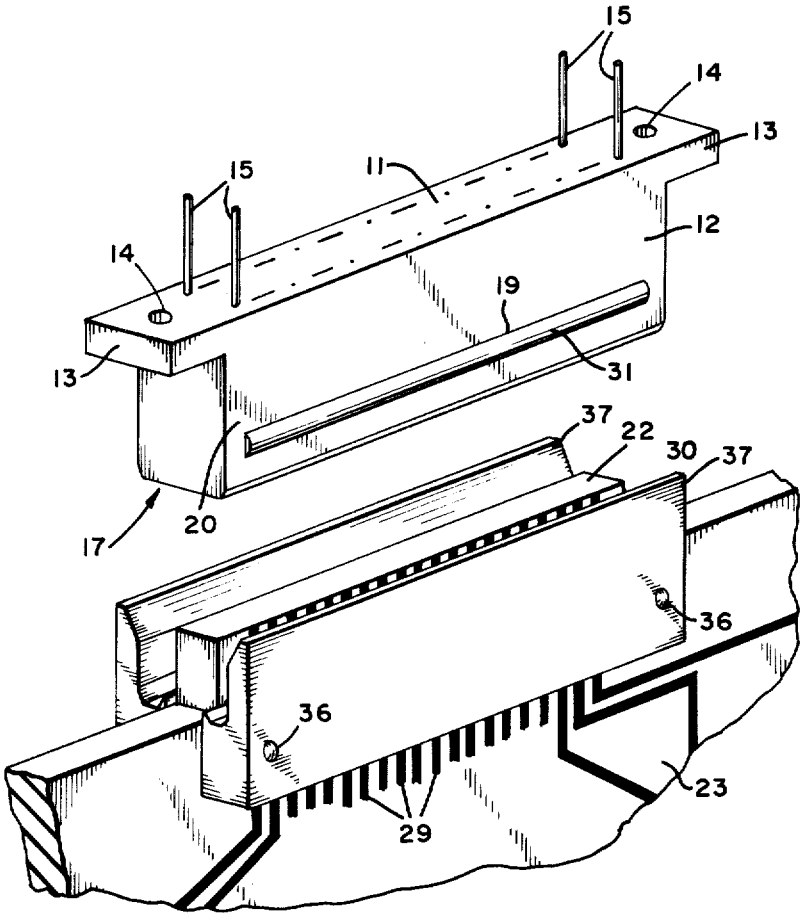
FIG. 1 is a perspective view of a female multipoint connector and of a coordinated, directly insertable printed circuit board.

In accordance with the present invention there is provided a plug connector for making a disconnectable electrical connection between a plurality of first contact elements or conducting electrical contact elements and an equal number of second contact elements or conductors.

The first contact elements are flexible without substantial spring properties and are supported by a first support element, which comprises at least one plug opening for zero force insertion of the second contact elements parallel to the first contact elements.

The second contact elements are supported by a second support element or a shell and are by themselves or in combination with additional elements formed for rigidly accepting the contact pressures exerted via their contact surfaces cross to the direction of the plugging process.

The contact pressures are provided by at least one permanent elastic element, which presses elastically the first contact elements with their contact surfaces against the in each case coordinated second contact elements based on a change in shape forced neither by the first contact elements nor by the second contact elements.

The first contact elements have coordinated elastic elements, which elastic elements are captively disposed in the first support element on the sides remote from the contact faces of the first contact elements such that the elastic elements are in a mechanical contact with the coordinated first contact elements and that the elastic elements protrude over one or more outside walls disposed parallel to the plug direction of the first support element such that the sum of the thicknesses of the first contact elements and of the coordinated unloaded elastic elements cross to the plug direction form active thicknesses, which in each case are larger than the width between the in each case coordinated edges of the plug openings and the points of the outside of the wall.

Each second support element or shell comprises at least one clamp having a U-shaped cross-section with two about equally long arms and the open end is directed in the plugging direction. One arm of each clamp is formed by at least one part of the second contact elements and the second arm of each clamp is formed by a clamp element rigidly connected to the second support element, wherein the contact surfaces of the second contact element are directed into the interior of the clamps and where the inner forms of the arms of the clamping elements are adapted to cooperate with the elastic elements of the first support elements, such that each clamp is provided at its open ende with a first clearance cross to the plugging direction which is larger than the coordinated active thickness such that it is provided in a region of about half the length of the arm with a constant inner diameter at its closed end, which diameter is smaller than the coordinated active thickness but larger than the cited coordinated width. Also, the transition from the first clearance to the second inner diameter is to be provided as a continuous function.

The plug connector can be employed for providing disconnectable electrical couplings between a plurality of first contact elements insulated with respect to each other and an equal number of second contact elements characterized in that the formation of an electrical connection is performed by way of a single manipulation by linear insertion of the first and of the coordinated second support element. At the beginning of the insertion process the first contact elements and the coordinated second contact elements are placed next to each other without force. During the insertion process each clamping elements surrounds the coordinated elastic element and increasingly deforms it elastically and cross to the insertion direction and presses it against the coordinated first contact elements whereby the first contact elements are pressed with increasing force are pressed elastically against the in each case coordinated second contact elements forming a rigid abutment. At the end of the insertion process the regions of constant inner diameter of the clamping elements and the elastic elements cooperating with them effect a plug connection safe against unwanted opening up, where there results no force component directed oppositely to the insertion direction.

Thus the plug connector of the present invention provides properties combining the advantages of state of the art female multipoint connectors with the advantages of the zero insertion force connectors. This results in a plug connection with a single manipulation, careful treatment of the contact surfaces at the beginning of the insertion process, reduced and not jumpwise changing insertion forces, sufficient rubbing for assuring of providing a safe contact and safe support for the inserted board without complicated support mechanisms.

Referring now to FIG. 1, there is shown a perspective view of a plug connector comprising a female multipoint connector 11 and a coordinated directly insertable printed circuit board 23 to be contacted with the female multipoint connector 11. The female multipoint connector 11 thereby provides a first support element for the conducting electrical contact elements or first contact elements and the printed circuit board provides a second support element for the second contact elements or conductors.

12 is the basic body of the female multipoint connector, which via a mounting element 13 and attachment holes 14 can be attached to a frame or a wiring circuit board. 15 designates a plurality of connector pins disposed in two rows next to each other and only the four limiting pins are designated. The connector pins can be provided for connecting plug connectors, soldered connectors, crimped connectors or other types of connectors. Each connector pin 15 is connected to a first contact element or a conducting electrical contact element in the basic body 12 and forms with the basic body one unit. Via the conducting electrical contact elements the desired electrical connection is provided between the connector pins 15 and the printed circuit conductor strips 29 of the printed circuit board 23. The printed circuit board 23 to be contacted can be inserted into the basic body 12 from below via a plug opening 17 covered in FIG. 1 corresponding to the position shown of the female multipoint connector 11 for the purpose of providing electrical contact and the printed circuit board is inserted via the insertion opening.

Each of the two longitudinal walls of the basic body 12 is provided with a slot opening 19 running parallel to the longitudinal edge, through which one or more elastic elements 31 protrude via the planar longitudinal sides 20 of the basic body 12 and disposed in parallel to the insertion direction.

The printed circuit board 23 is provided on both of its sides with conductor strips 29, which end as is known directly plugging boards in one in each case of rows of parallel contact strips 30 at a protrusion 22 of the board 23. These contact strips 30 form the second contact elements or conductors of the printed circuit board. They are covered on both board sides by a clamping element 37 in each case. These clamping elements 37 are rigidly connected to the printed circuit board 23 via rivets or screws 36. During the insertion process they slide over the elastic elements 31, which as described protrude from the planar longitudinal sides 20 of the basic body 12. Therewith these elastic elements are pressed towards the inside and are elastically deformed.

FIG. 2 shows the female multipoint connector 11 and the circuit board 23 in a sectional view cross to their longitudinal directions. The designations correspond to those of FIG. 1. The basic body 12 of the female multipoint connector 11 is hollow. In the recess 21 there are in two rows the previously mentioned conducting electrical contact elements 25 as an extension of the connector pins 15. These can be individual contact lugs or can be assembled conductors formed as flexible printed circuit boards, wherein the contact surfaces are directed against each other and towards the inside. The contact elements 25 are weakly elastic. The elasticity serves to keep the conducting electrical contact elements 25 in the direction of the double arrow C in a rest position, such that the recess 21 is open over the width of the socket opening 17. The corner edges 28 of the basic body 12 support this purpose. However, the elasticity does not serve to provide a contact pressure force when the printed circuit board 23 is inserted.

The printed circuit board 23 with its conductors 30 or second contact elements is carefully guided through the insertion opening 17 and slid into the recess 21 without exertion of appreciable force. The elastic elements 31 can be for example profiles from silicone-rubber. They are disposed captively in the suitably formed slot openings 19 of the planar longitudinal walls of the basic body 12 and cannot be lost. The elastic elements 31 protrude with their regions 33 clearly from the openings 19 beyond the longitudinal sides 20 and on the other side contact slightly the conducting electrical contact elements 25 in the inside of the female multipoint connector 11.

The printed circuit board 23 is formed as a conventional circuit board printed on two sides. The protrusion 22 supports as described above the conductors 30 or second contact elements. These are printed conductor strips disposed in parallel to each other ending at the protrusion 22. The clamping elements 37 are placed mirror symmetric on both sides of the printed circuit board 23, they are rigidly attached and they have an L-shaped cross-section.

Each clamping element 37 forms together with the coordinated conductors 30 and the protrusion 22 a U-shaped clamp. The one arm of the clamp is formed by the free region 39 of the clamping element 37 and the other arm of about equal length is formed by the protrusion 22 with the conductor strip 30 and the bow of the U is formed by the attachment region 38 of the clamping element 37. The open end of the clamp is directed in the insertion direction, which is designated by the arrow S.

The sides of the U-shaped arm forming regions 39 of the clamping elements 37 directed towards the inside are wedge-shaped bevelled. From this the wedge tips 41 result and the wedge regions 42 are formed ending about at the middle of the arm and regions of constant inner diameter 43 follow thereto in the direction of the bow of the U-shape. In these regions 43 is the inner diameter between the conductors 30 and the arms of the clamping elements about constant as determined cross to the insertion direction.

Figure 3:
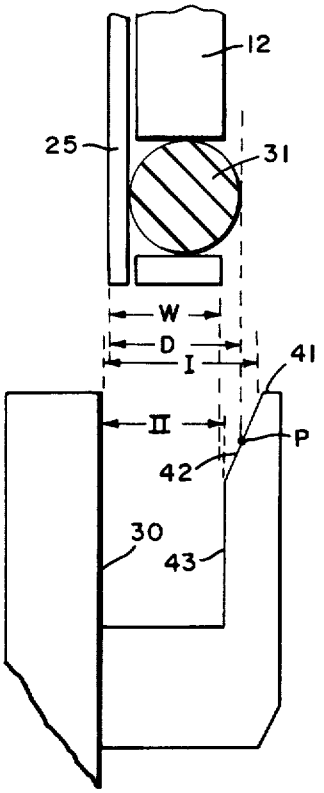
FIG. 3 is a view of a schematic representation of a plug connector with dimensional designations on an enlarged scale.

FIG. 3 demonstrates this on a larger scale. FIG. 3 shows at the top a conducting electrical contact element 25 and an elastic element 31 touching the conducting electrical contact element 25 and the total width of the conducting electrical contact element and the elastic element is D cross to the direction of insertion. D is clearly larger than the sum W of the wall thickness of the basic body 12 plus the thickness of the contact element 25 or respectively the distance of the inner points of the conducting electrical contact element to the outer points of the outer wall. The clearance I cross to the insertion direction S between the tip of the wedge 41 and the conductors 30 is clearly larger than D. The clearance decreases continuously in the region of the wedge 42 and at the point P it becomes equal to D. Finally, the wedge region ends in a region of substantially constant inner diameter 43, where the clearance II is about constant and smaller than D, but larger than W ($W<II<D<I$).

This way upon insertion of the printed circuit board 23 into the female multipoint connector 11, the wedge tips 41 slide without touching over the elastic elements 31 and touch the same only after the conductors 30 are disposed next to the conducting electrical contact elements 25. The elastic elements 31 become increasingly deformed with advancing insertion and press the elastic elements 31 cross to the insertion direction S into the inner part of the female multipoint connector 11. This way the pressure on the elastic elements 31 is increased during the insertion process and the elastic elements 31 exert an increased pressure against the conducting electrical contact elements 25. Thereby the conducting electrical contact elements 25 are pressed against the conductor strips 30, which rigidly receive the pressure together with the protrusion 22. Upon completely inserted printed circuit board 23 the elastic elements 31 are maximal deformed by the regions of constant inner diameter 43 and are pressed into the interior of the female multipoint connector 11. Based on the selected geometry no force component results against the insertion direction S acting on the printed circuit board 23. By providing slight bevels opposite to the directions of the wedge regions 42 it is even possible to provide a small force component acting in the direction of insertion S. By way of this force and of the frictional forces the printed circuit board is safely supported and kept within the female multipoint connector 11.

The force with which the contact surfaces of the conducting electrical contact elements 25 and the conductors 30 are pressed together depends on the dimensions D, I, and II as well as the properties of the elastic elements 31. The cooperation of the elastic elements 31 of the female multipoint connector 11 and the U-shaped clamps of the printed circuit board results during the insertion process initially in a zero force engagement. Then a uniformly increasing elastic force opposing the insertion force has to be overcome and the conducting electric contact elements and the conductors are pressed against each other. At the end of the insertion process a much reduced insertion force results, since only the frictional forces have to be overcome acting between the inner sides of the arms 39 and the coordinated elastic elements 31 as well as between the to be contacted conducting electrical contact element 25 and the conductor 30.

Figure 4:
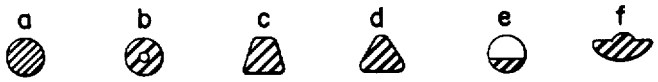
FIG. 4 is a view of cross-sections of various elastic elements.

There are shown in FIG. 4 some examples for cross-sectional shapes of the elastic elements substantially forming strandlike elastic elements 31. According to FIG. 4*a* the cross-section is circular, according to FIG. 4*b* tubular, according to FIG. 4*c* trapezoidal, according to FIG. 4*d* triangular, according to FIG. 4*e* circular, where in regular spacings from one side notches are provided, and according to FIG. 4*f* such that a semicircle of smaller diameter and a semicircle of larger diameter are joined at their straight base lines. These strandlike profile materials are inserted such into the slot openings 19 of the female multipoint connector 11 that they protrude on the side of the planar longitudinal wall as described above. The form provided to the profile material is such that the elastic elements are captive in the slot and are kept substantially unmovable in the slot openings 19. When employing elastic elements according to FIG. 4*e* the slot openings 19 can be gratelike subdivided thereby increasing the stability of the female multipoint connector 11.

The female multipoint connector 11 described with reference to FIGS. 1 to 4 by way of example meets the initially stated requirements for a plug connector in cooperation with the printed circuit board 23 and the clamping elements 37. Despite zero force engagement by and during the insertion process the necessary contact pressure for contacting is provided and in the inserted state no force results directed to disconnect the plugged connectors. The female multipoint connector 11 and the printed circuit board 23 cooperating do not exhaust the present invention. However, a considerable number of additional connectors exist also meeting the stated requirements.

FIG. 5 shows a female multipoint connector and a male multipoint connector for an indirectly insertable printed circuit board as an example for a corresponding plug connector. The base body is designated as 12 and forms the female multipoint connector 11, the connector lugs 15 of which are connected for example with a supporting connecting plate 16 mechanically and electrically by soldering. Two rows of conducting electrical contact elements 25 having contact faces towards the inside are disposed in the inside of the basic body 12 as an extension of the connecting lugs 15. Slot openings 19 are again contained in the side walls and they are housing strand-shaped elastic elements 31. In contrast to the female multipoint connector of FIG. 2, the female multipoint connector of FIG. 5 is provided with a ridge middle part 45 providing individual guides or receiving openings 46 for the conductors formed as free pins 48 to be inserted. These guides provide a clear electrical separation of the conducting electrical contact elements 25 as well as of the therewith to be contacted conductors 48 with respect to each other.

The lower part of FIG. 5 shows as a contrast to the female multipoint connector 11 a printed circuit board 23 having attached on its side a multipoint strip 47. The multipoint strip 47 supports two rows of individual pins 48 next to each other, which pins have their contact surfaces directed towards the outside and having their connecting ends outside of the multipoint strap rectangularly bent and soldered to the printed circuit board. The individual pins 48 are on their side surrounded by a U-shaped clamping element, which forms the basic body for the multipoint strap 47. Both arms 40 of the U are bevelled inside and have in each case a wedge pin 41, a wedge region 42 and following to this a region of substantially constant inner diameter 43.

In accordance with FIGS. 2 and 3 each arm 40 forms a U-shaped clamp with the coordinated individual pins 48. The clearances I and II cross to the insertion direction are larger or respectively smaller than the total width D of the sums of the thicknesses of the first contact elements 25 and the elastic elements 31 of the female multipoint connector 11. The rigid counterpressure is provided by the ridge middle piece 45, at which the individual pins slide along during insertion and against which they are pressed by the deforming forces of the elastic elements 31.

In another embodiment of the present invention the ridge middle piece 45 of the female multipoint connector 11 can be transferred to the multipoint strip 47, where it is disposed between the rows of pins 48 such that it touches the pins. The insertion openings 46 of the female multipoint connector 11 thereby unite to a single opening and the sidewalls of this opening can be provided with small notches and ridges effecting an exact guiding of the conductors that is the pins 48. The rigid counterpressure is provided by the middle piece combined with the pins 48 in this case.

The advantage of an indirectly inserted printed circuit board compared with a directly inserted printed circuit board resides as with conventional printed circuit boards in cleanly guiding all contact elements and in insulating them problemfree against each other. This eliminates the danger, that upon canted insertion neighboring first contact elements or conducting electrical contact elements 25 are faulty connected with each other via the imprecisely disposed conductors 30.

FIGS. 6*a* and 6*b* show additional embodiments for the clamping elements combining the clamping property with the additional property of exerting an elastic pressure. In both cases the clamping elements comprise springs 53 or respectively 54 which substitute for the rigid U-arms of the FIGS. 1, 2, 3 and 5. As correspondingly described by way of FIG. 2 the other U-arm is provided by the protrusion 22 of the printed circuit board 23 and by the contact strips 30 disposed thereon. The springs 53 or respectively 54 and the printed circuit board 23 forming the U-arms are connected via rigid block pieces 55.

The inside of the springs 53 or respectively 54 is formed such that at the open end of each U-shaped clamp there results a clearance cross to the insertion direction being larger than the total width D as defined by way of FIG. 3, whereas the region disposed further inside is provided with an inner diameter which is smaller than D. This provides for the open end of the U-shaped clamp upon insertion to slide without touching over the elastic elements of the coordinated female multiple point connector 11. The contact pressure necessary for providing electrical contact is in the inserted state generated not solely by the deformation of the elastic elements 31 (FIG. 2) but additionally by the spring forces of the springs 53 or respectively 54. Since these springs can be formed with relatively long arms, this way the requirements relating to the mechanical tolerances can be decreased.

Figure 7:
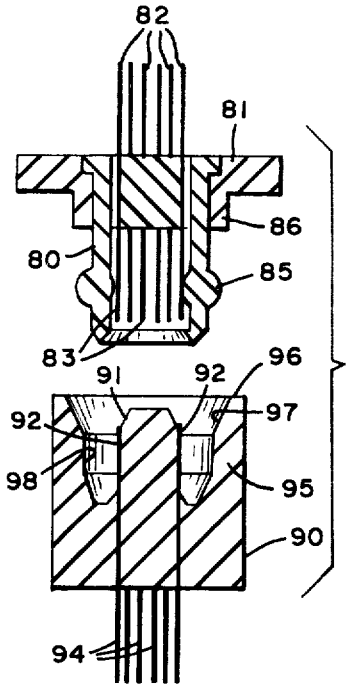
FIG. 7 is a sectional view of a circular socket and of a coordinated circular plug.

As a further embodiment of the present invention FIG. 7 shows a circular socket 80 and a coordinated circular plug 90. The circular socket 80 can be attached to a support element by way of a flange 81 such as for example from sheet metal. The connection pins 82 extend in the interior of the circular socket in weakly elastic contact strips 83 having their contact surfaces disposed towards the inside. The contact strips 83 are surrounded with a tubular, rubberelastic elastic element 85 on their outside, which is enlarged like a swelling at the level of the contact surfaces and which is circularly surrounded by the collar 86 of the flange 81 at the level of the flange and which is clamped.

The circular plug 90 can be inserted into the circular socket 80. The circular plug 90 comprises a central, cylindrical middle part 91, which is surrounded on its circumference by conductors or second contact elements 92 running parallel to its axis. The contact surfaces of these second contact elements 92 are directed toward the outside and the extensions of the second contact elements 92 form the connection pins 94. The center part 91 is concentrically surrounded by a clamping element 95, which is at its free end wedge-shaped bevelled. This results in a circular wedge tip 96 and a corresponding wedge region 97, which are followed toward the inside by a region 98 of constant diameter.

The circular plug 90 engages at the beginning of the insertion with zero insertion force with its middle part 91 and its wedge tip 96. Upon advancing insertion the wedge region 97 deforms the swelling of the tubular elastic element 85 and presses it toward the inside. Thereby the contact strips 83 are pressed against the conductors 92. Finally, at the end of the insertion process the region of constant diameter 98 deforms to a maximum the elastic element 85 and in fact such that no force component on the circular plug occurs against the direction of insertion.

Figure 8:
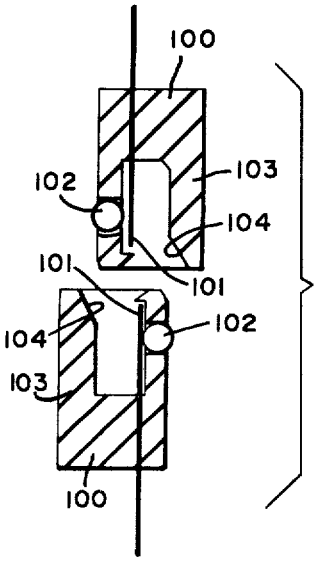
FIG. 8 is a sectional view of two identical female multipoint connectors adapted to be inserted into each other.

As a further embodiment of a connector according to the present invention, FIG. 8 shows two insertable, identical multipoint connectors 100. These multipoint connectors 100 are provided with contact elements 101, which in the inserted state touch each other with their contact surfaces. On the sides of the contact elements removed from the contact sides there is disposed in each multipoint connector a strand-shaped elastic element 102, which is pressed by a clamping element 103 of the in each case other multipoint connector 100 against the contact elements 101. Here, the elastic elements 102 and the clamping elements 103 mutually receive the counterpressure in each case such that no force component results possibly effecting a sliding apart of the two multipoint connectors 100. The sliding together of the two multipoint connectors 100 is made possible by the wedge-shaped form of the clamping elements 103, which exhibit at their free end wedge regions allowing a zero force engagement of the two multipoint connectors.

Upon sliding together of the up to now described plug connectors the inner surfaces of the clamping elements, that is the wedge regions (42,97,104) and the regions of constant inner diameter (43) or respectively (98), slide over the coordinated elastic elements. Thereby the elastic elements are also deformed in insertion direction and are mechanically worn. Therefor, an improvement of the plug connectors results then when the desired deformation cross to the insertion direction is not forced with a sliding process, but if the deformation results from a rolling motion. An example for this is shown in FIG. 9.

Figure 9:
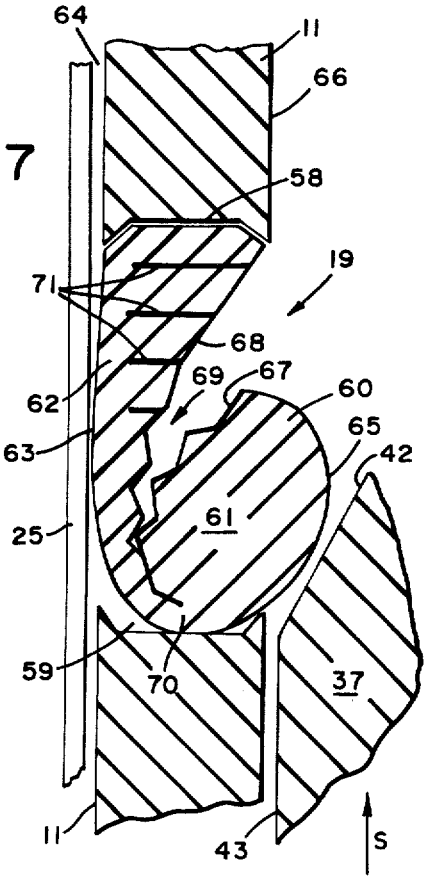
FIG. 9 is a sectional view of the side wall of a female multipoint connector and of an elastic element on an enlarged scale.

A sectional view of the longitudinal wall of a multipoint connector 11 with a slot opening 19 is shown in FIG. 9 on an enlarged scale when compared with the other figures. An elastic element 60 is clamped under slight pretensioning in the concave recesses 59 and 58 of the sidewall delineating the slot opening. The elastic element has an approximately oval cross-section and with the oval part 61 is homogeneously connected a nearly linear part 62 expanding toward the outside like a wedge. In rest position that is with unplugged multipoint connector 11 the elastic element 60 deforms with the end of the linear part 62 in the concave recess 58 and with the connection region 70 between the nearly linear part 62 and the approximately oval part 61 at the recess 59. This way the nearly linear part 62 closes with its about planar outer surface 63 the slot opening 19 toward the inside 64 of the multipoint connector 11 and touches the contact element 25 at its back side. In contrast, the oval part protrudes with its pressure region 65 clearly beyond the outer wall 66 of the multipoint connector 11. A wedge-shaped slot 69 open toward the outside thereby is disposed between the inner side 67 of the oval part 61 and the inner side 68 of the linear part 62.

If during the insertion process the wedge region 42 of a clamping element 37 is slid in the direction of the arrow S via the pressure region 65 protruding toward the outside of the oval part 61, then based on the prevailing geometric conditions and the therefrom resulting force components as well as the resulting frictional forces this pressure region 65 is carried along in the direction of the arrow S, while the connecting region 70 between the oval part 61 and the linear part 62 cannot go along with the cited motion in the direction of the arrow S based on the geometric disposition and stiffness of the linear part 62. This results in a roller motion of the oval part 61, wherein the oval part with its inner side 67 rolls off on the inner side 68 of the linear part 62 and the linear part 62 with its narrow end joining the connection region 70 is coiled on the oval part 61. During this motion the wedge-shaped slot 69 is increasingly closed by necessity. At the same time the clamping element 37 with its wedge region 42 or upon advanced insertion with its region of constant diameter 43 presses on the oval part 61, whereby the oval part including parts of the linear part 62 are elastically deformed cross to the direction of insertion S and is pressed in the inner region of the female multipoint connector 11. This escape motion can be eased by slots 71, which are disposed cross to the longitudinal direction of the linear part 62 and starting from the inner side 68 of the linear part 62. Furthermore the roller motion of the oval part can be assured and a sliding can be avoided by having a toothed inner side 67 and a toothed side 68, which are coordinated to each other resulting in a toothed smooth connection produced by the roller motion. Correspondingly, a possible sliding motion between the pressure region 65 of the oval part 61 and the clamping element 37 can be prevented by providing the surface of the clamping element 37, that is the wedge region 42 and the region 43, of constant inner diameter with light teeth or roughening, again tuned to a corresponding surface form of the oval part 61.

Upon withdrawal of the printed circuit board from the female multipoint connector 11 the oval part 61 rolls off in opposite direction and rests again with slight pretensioning in the concave recess 59 at the lower end of the slot opening 19.

The elastic element 60 can be formed such that upon rolling off of the oval part 61 on the inner side 68 of the linear part 62 the sum of active diameter of the oval part 61 and active width of the linear part 62 remains constant. In this case, the deformation necessary for the generation of the contact force can occur by decreasing the clearance of the clamping element 37. Upon a smaller variation of the inner clearance of the clamping element 37, the generation of an elastic deformation of the elastic element 60 is furthermore also possible by increasing the active total diameter of both parts during the rolling process by providing suitable forms for the oval part 61 and/or of the linear part 62.

In the following there shall be mentioned the additional embodiments as follows:

Between a wedge region such as for example 42 of FIG. 2 and the region 43 of constant inner diameter there can be provided either an edge type transition or preferably a smooth transition. In the latter case there results upon insertion of the plug connectors a continuous change of the insertion forces.

A safe support of the conductor or second contact element, such as for example of the printed circuit board 23 in the female multipoint connector 11 (FIG. 1) is effected by the frictional forces and the lack of a resulting force component directed against the insertion direction S as described above. An improvement is possible by bevelling the region of constant inner diameter as for example shown at 43 in FIG. 2 such that a resulting force component is directed in the insertion direction S. The same effect can be achieved by providing the region of constant diameter with instead a slightly trough-shaped form.

For decreasing the described sliding friction between the elastic elements such as for example 31 in FIG. 2 and the wedge region 42 as well as the region of constant inner diameter 43 of the coordinated clamping element 37 on the other hand the surfaces can be provided as more smooth by modifying the properties of the surfaces such as for example by a tetrafluoropolyethylene coating. A further possibility is provided in the disposing of a low friction intermediate layer between the elements cited, which for example is additionally placed at the female multipoint connector 11 such that the regions 33 of the elastic elements 31 protruding over the longitudinal sides 20 of the female multipoint connector are covered.

The wedge regions 42 can be provided with various slopes in the longitudinal direction of the plug connector resulting in a warped edge surface. This can serve the purpose to contact selected conducting electrical contact elements 25 earlier or later than other contact elements, which is desirable for example in circuits employing CMOS-devices.

Figure 10:
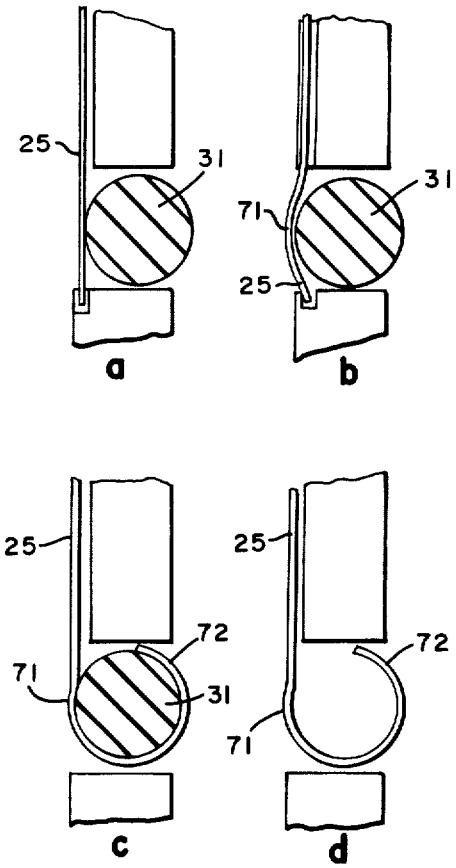
FIG. 10 is a sectional view of representations of various combinations of conducting electrical contact elements and of elastic elements.
Figure 10:
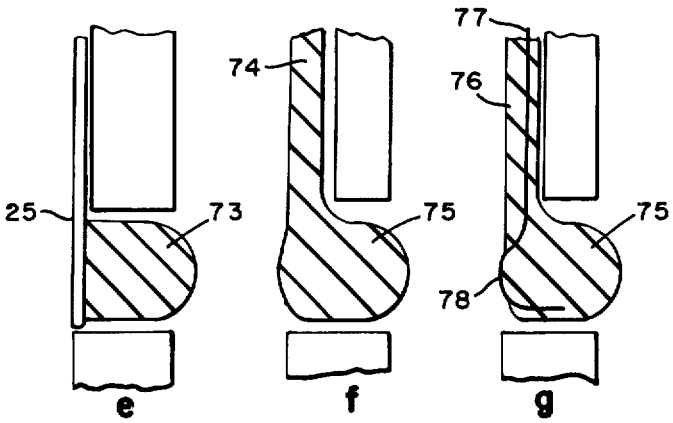

The conducting electrical contact elements 25 of FIG. 2 are by way of FIGS. 2, 5, 7, 8 always depicted as planar contact strips. This provides the advantage of simple production, but results in the disadvantage that the contact forces are distributed and diffused over a relatively large area and the contact pressures become relatively small. FIG. 10 shows various embodiments of conducting electrical contact elements and of coordinated elastic elements in a cross-sectional schematic view. FIG. 10*a* represents the above mentioned case of a substantially planar, metallic contact element 25 and its strand-shaped circular profile elastic element 31. The contact face 71 of the contact element 25 is bent convexly as shown in FIG. 10*b* and in the concave counter recess is disposed a circular profile elastic element 31. In FIG. 10*c* is shown the contact element 25 with its contact surface 71 and its continuation 72 bent circularly around the elastic element 31. The elastic element can also be eliminated or be substituted in case the continuation 72 is provided with sufficient spring properties. This is shown in FIG. 10*d*. In this case the continuation 72 forms the required spring element or elastic element, which is homogeneously connected with the conducting electrical contact element 25. In FIG. 10*e* is shown a rubberelastic element 73 solidly connected to the spring element 25 such as is for example obtainable by gluing. FIG. 10*f* shows as a further example the combination of elastic element and spring element as provided by a rubber-elastic component 74 with a swelling 75, which comprises alternate layers of electrically conductive and of electrically nonconductive material and the layering is provided in the orthogonal direction relative to the plane of the drawing. Each conducting layer takes on the function of an individual conducting electrical contact element, while the swelling 75 performs the function of the elastic element. Finally, the component 76 of FIG. 10 is similarly constructed, where narrow metallic conductors 77 are cast into rubber-elastic material such that the conductor appears at the surface of the component at the inner side of the swelling 75 as a contact surface 78.

A female multipoint connector 11 can instead of two rows comprise only one row of conducting electrical contact elements 25, such as for example employed in connection with a circuit board printed only on one side.

As a second support for second contact elements or conductors there can also be employed a thick film substrate plate instead of the conventional printed circuit board.

It will be understood that each of the elements described above, or two or more together, may also find a useful application in other types of system configurations and connecting procedures differing form the types described above.

While the invention has been illustrated and described as embodied in the context of a multipoint connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Mated connectors for providing a disconnectable electrical contact including a socket comprising a support element;

a conducting electrical contact element connected through the support element;

a limb attached to the support element running about parallel to the conducting electrical contact element and having a diameter in a direction about vertical to the surface of the conducting electrical contact element and forming together with the conducting electrical contact element a width in a direction about vertical to the surface of the conducting electrical contact element;

an elastic element captively disposed in a hole in the limb and located closely adjacent to the conducting electrical contact element and protruding on the side of the limb opposite to the location of the conducting electrical contact element and being of larger extension in the direction of the diameter of the limb than the diameter of the limb; and a plug comprising a shell;

a conductor disposed on the shell for engaging the conducting electrical contact element;

a clamping arm extending for roughly the same length as the conductor and running about parallel to the conductor at a clearance distance of approximately slightly more than the width of the limb and the conducting electrical contact element and having a bevelled edge near at the tip of the arm disposed toward the conductor and providing at the tip a clearance between conductor and clamping arm of larger than the total width of the elastic element and the conducting electrical contact element.

2. The mated connectors according to claim 1 wherein the socket comprises a plurality of conducting electrical contact elements insulated with respect to each other and wherein the plug comprises a plurality of conductors insulated with respect to each other.

3. The mated connectors according to claim 1 wherein socket and plug are mated for forceless insertion into each other with the conducting electrical contact elements about parallel to the conductor.

4. The mated connectors according to claim 1 wherein the conducting electrical contact element is without substantial spring properties.

5. The mated connectors according to claim 1 wherein the conducting electrical contact element is flexible.

6. The mated connectors according to claim 1 wherein the clamping arm upon insertion exerts a contact pressure via the elastic element pressing the conducting electrical contact element against the conductor.

7. The mated connectors according to claim 6 wherein the elastic element becomes deformed from the pressure exerted by the clamping arm.

8. The mated connectors according to claim 1 wherein the elastic element is disposed in mechanical contact with the conducting electrical contact element.

9. The mated connectors according to claim 1 wherein there is provided in the plug a continuous transition from the bevelled edge of the arm to the surface of the arm facing the conductor.

10. The mated connectors according to claim 1 wherein the clamping arm is substantially rigid.

11. The mated connectors according to claim 1 wherein the clamping arm is at least in part spring-elastic.

12. The mated connectors according to claim 1 wherein the inside clearance of the conductor and of the arm is lowest in the area where the bevel connects to the clamping arm proper.

13. The mated connectors according to claim 1 wherein the socket is formed as a female multipoint connector with a single plug opening, which comprises at least a row of conducting electrical contact elements disposed next to each other and wherein the female multipoint connector comprises a slot in a parallel direction to the row in which slot the elastic element is disposed captively as a strand-like rubber-elastic profile element.

14. The mated connectors according to claim 13 wherein the conductors of the plug are disposed as a printed circuit board having printed conductor strips disposed in parallel on at least one of its two sides and wherein at least one clamp is formed with a U-shaped cross-section by the protrusion of the shell carrying the conductors and by the clamping arm having an L-cross-sectional shape rigidly connected to the circuit board supporting the conductors.

15. The mated connectors according to claim 1 wherein the socket is a female multipoint connector comprising at least one row of next to each other disposed conducting electrical contact elements, wherein to each conducting electrical contact element is coordinated a ridge for securing and supporting in each case an individual second contact element and wherein there is provided a slot opening in the side wall of the female multipoint connector which slot contains captively as elastic element a strand-shaped rubber-elastic profile element.

16. The mated connectors according to claim 15 wherein the plug forms a male multipoint connector comprising at least one row of pins as conductors and wherein the rows of pins are surrounded on both sides by clamping arms which form together with the base of the male multipoint connector the U-shaped clamp.

17. The mated connectors according to claim 1 wherein the socket has a circular cross-section and wherein the conducting electrical contact elements have their longitudinal direction parallel to the circle axis and are disposed concentrically and wherein the elastic element is an enlargement of the limb surrounding circularly the conducting electrical contact elements.

18. The mated connectors according to claim 17 wherein the plug is a circular plug further comprising a cylindrical center part surrounded by the conductors, wherein the clamping arm is a part rigidly connected to and cylindrically surrounding the cylindrical middle part and the conductors and the clamping arm part together with the cylindrical center part form a circular clamp with U-shaped profile.

19. The mated connectors according to claim 1 wherein the socket and the plug are identically shaped female multipoint connectors having a U-cross-section and supporting a row of contact elements, wherein the row of conducting electrical contact elements is disposed next to a limb, wherein the limb is provided with a slot opening running in parallel to the longitudinal direction of the multipoint connector and a strand-shaped elastic element is disposed in the slot opening, and wherein the clamping arm is bevelled toward the inside like a wedge.

20. The mated connectors according to claim 1 wherein said conducting electrical contact element is mechanically connected to a coordinated elastic element.

21. The mated connectors according to claim 1 wherein each conducting electrical contact element is joined with a coordinated elastic element to an inseparable mechanical unit.

22. The mated connectors according to claim 1 wherein the elastic element is a strand-shaped rubber-elastic profile element having a profile comprising an oval part with approximately oval cross-section and a nearly linear part connected thereto and the cross-section of the nearly linear part starting at the connection point with the oval part extends toward the outside and where an open wedge-shaped slot is disposed between the oval part and the nearly linear part.

23. The mated connectors according to claim 22 wherein the wedge-shaped slot of the profile element is provided with toothed surfaces such that upon rolling together of oval part and nearly linear part the teeth engage smoothly.

24. A method for making electrical connections comprising providing a socket having a conducting electrical contact element disposed adjacent to a limb;

providing a plug having a conductor and a clamping arm rigidly attached to a shell;

plugging the conducting electrical contact element and the limb into the clearance between the conductor and the clamping arm; pressing an elastic element disposed in a slot of the limb with the clamping arm; and pressing the conducting electrical contact element with the elastic element against the conductor.

25. The method for making electrical connections according to claim 24 wherein the socket comprises a plurality of conducting electrical contact elements each insulated against the others and wherein the plug comprises a plurality of conductors each insulated against the others.

26. The method for making electrical connections according to claim 24 wherein the plugging together of the socket and the plug is done by a single manipulation of linear plugging together.

27. The method for making electrical connections according to claim 24 wherein at the start of the plugging the conducting electrical contact elements and the coordinated conductors are placed next to each other without application of force.

28. The method for making electrical connections according to claim 24 further comprising gripping each elastic element with a coordinated clamping arm during the plugging step;

deforming the elastic element and pressing the elastic element cross to the plugging direction against the conducting electrical contact element and thereby pressing the conducting electrical contact element against the conductor for forming a rigid abutment;

forming at the end of the plugging step a plug connection safe against unwanted opening up by the clamping of the elastic element with the clamping arm where there is no force exerted in the direction opposite to the insertion.

* * * * *